US005663131A

United States Patent [19]

Winicov et al.

[11] Patent Number: 5,663,131

[45] Date of Patent: Sep. 2, 1997

[54] CONVEYOR LUBRICANTS WHICH ARE COMPATIBLE WITH PET CONTAINERS

[75] Inventors: Elsie Winicov, Kansas City, Mo.; Chris Foret, Shawnee Mission, Kans.; Cynthia Palmer, Kansas City, Mo.; Michael W. Griffith, Kansas City, Kans.; Thomas C. Hemling, Lake Winnebago, Mo.

[73] Assignee: West Agro, Inc., Kansas City, Mo.

[21] Appl. No.: 631,058

[22] Filed: Apr. 12, 1996

[51] Int. Cl.[6] ..... C10M 173/02; C10M 129/16

[52] U.S. Cl. ..... 508/580

[58] Field of Search ..... 508/579, 580

[56] References Cited

U.S. PATENT DOCUMENTS

| | | | |
|---|---|---|---|
| 3,072,506 | 1/1963 | Kopietz | 508/580 |
| 3,236,778 | 2/1966 | McIntosh | 508/580 |
| 3,699,057 | 10/1972 | Halko et al. | 508/579 |
| 3,755,168 | 8/1973 | Mixon et al. | 508/580 |
| 3,925,216 | 12/1975 | Moorhouse | 508/579 |
| 4,274,973 | 6/1981 | Staton et al. | 508/459 |
| 4,302,349 | 11/1981 | Kosswig et al. | 508/580 |
| 4,414,121 | 11/1983 | Aiello | 508/178 |
| 4,491,526 | 1/1985 | Deck | 508/579 |
| 4,624,299 | 11/1986 | Harding et al. | 508/580 |
| 4,731,190 | 3/1988 | O'Lenick, Jr. et al. | 508/579 |
| 4,859,351 | 8/1989 | Awad | 508/579 |
| 4,941,981 | 7/1990 | Perricone et al. | 508/579 |
| 5,080,814 | 1/1992 | Awad | 508/579 |
| 5,143,640 | 9/1992 | Moxey | 508/579 |
| 5,182,035 | 1/1993 | Schmidt et al. | 508/527 |
| 5,202,037 | 4/1993 | Lavelle et al. | 508/511 |
| 5,259,970 | 11/1993 | Kanamori et al. | 508/579 |
| 5,286,300 | 2/1994 | Hnatin et al. | 508/579 |
| 5,334,322 | 8/1994 | Williams, Jr. | 508/579 |
| 5,352,376 | 10/1994 | Gutzmann | 508/216 |

OTHER PUBLICATIONS

Mona Industries, Inc.; MONATROPE 1250, Technical Bulletin. ( no date).

Mona Industries, Inc.; MONOFAC 1214, Technical Bulletin (no date).

BASF; PLURONIC & TETRONIC Surfactants, Technical Bulletin (no date).

GAF; Igepal, nonionic Surfactants, Technical Bulletin (no date).

Stepan Product Bulletin; Ninol 11–CM, Detergent Grade Alkanolamide (no date).

Dow Chemical Co.; Versene Chelating Agents (no date).

Dow Chemical Co.; Dowicil 75, Technical Bulletin (no date).

Diversey; DICOLUBE PL, Technical Bulletin (no date).

Rhone–Poulenc; Listing of Surfactant and Specialty Products (no date).

Rhone–Poulenc; RHODAFAC; Anionic Surfactant, Technical Bulletin (no date).

*Primary Examiner*—Ellen M. McAvoy

*Attorney, Agent, or Firm*—Hovey, Williams, Timmons & Collins

[57] ABSTRACT

Improved conveyor lubricants are provided which are compatible with thermoplastic articles such as containers made of polyalkylene terephthalates. The lubricants are essentially free of oil and include a nonionic surfactant (e.g., a nonylphenol ethoxylates) dispersed in water where the surfactant has a molecular weight of at least about 1000 and contains at least about 12 ethylene oxide moieties therein. The surfactant should preferably comprise at least about 50% by weight of the non-aqueous components of lubricant concentrates and use dilutions. In use, the concentrates are diluted and sprayed or otherwise applied onto handling equipment for the thermoplastic articles. The use dilution surfactants of the invention give very advantageous lubricity ratio and crazing values, making them eminently suited for use with PET containers.

39 Claims, 1 Drawing Sheet

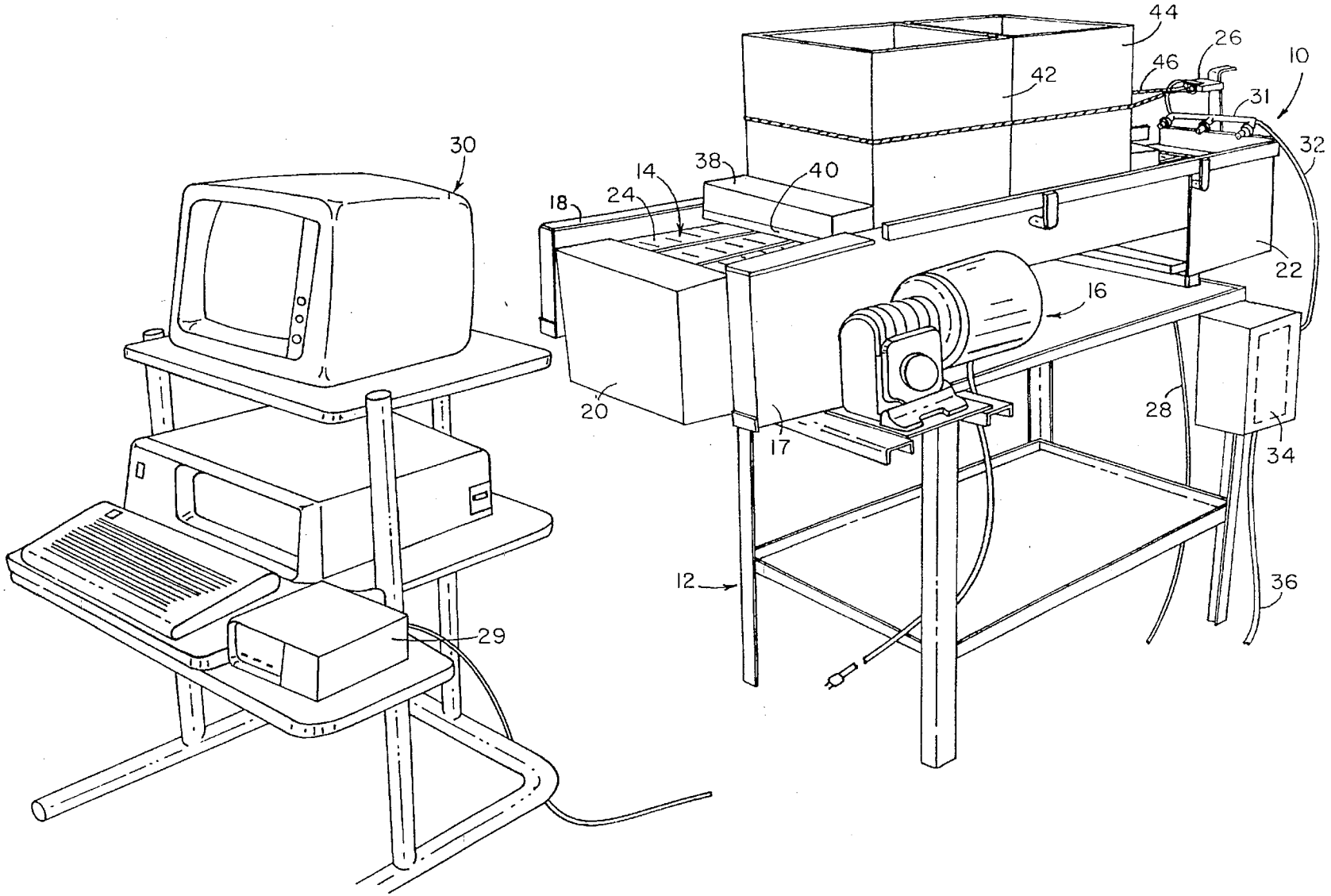
10
32
31
26
44
46
42
22
34
36
28
16
40
17
38
12
14
24
20
18
30
29

CONVEYOR LUBRICANTS WHICH ARE COMPATIBLE WITH PET CONTAINERS

BACKGROUND OF THE INVENTION

1. Field of the Invention

The present invention is broadly concerned with improved, nonionic surfactant-based aqueous lubricants adapted for lubricating equipment designed to handle thermoplastic articles subject to stress cracking (e.g., polyethylene terephthalate (PET) containers). More particularly, the invention pertains to such lubricants in concentrate or use dilution form, and to methods for lubricating handling equipment, wherein the lubricant compositions are essentially free of oil and include a nonionic surfactant dispersed in water; the surfactant has a molecular weight of at least about 1000 and includes at least about 12 ethylene oxide moieties therein. Moreover, the surfactant makes up at least about 50% by weight of the non-aqueous components of the lubricant. Lubricants in accordance with the invention have been shown to have lubricity ratio and crazing values rendering them particularly suitable for use with conveyors and other handling equipment for PET containers.

2. Description of the Prior Art

Thermoplastic food and beverage containers are transported between cleaning, labeling, filling and packaging stations by conveyors and related equipment. In order to keep the conveyors clean and lubricated, and to facilitate handling of the containers, aqueous lubricants are conventionally sprayed onto the conveyors. Generally, the lubricants are supplied as concentrates and are diluted by the end user. In order to be successful, the aqueous lubricants must provide a lubricating function and should also facilitate cleaning and removal of food or beverage spills. Moreover, they must be compatible with tap water used as a diluent. A variety of materials have been used in the formulation of prior conveyor lubricants including fatty acid soaps (U.S. Pat. No. 3,860,521), phosphate esters (U.S. Pat. No. 4,521,321), fatty amines (U.S. Pat. No. 4,839,067) and alpha olefin sulfonates (U.S. Pat. No. 4,604,220). It is also known to incorporate ingredients such as chelating agents, alcohols and low molecular weight glycols in order to improve the physical stability and operational characteristics of the lubricants.

It has been found that many prior aqueous lubricants can deleteriously affect certain types of thermoplastic materials such as PET, PBT (polybutylene terephthalate), polysulfones and polycarbonates, in that bottles or other articles formed of these materials are prone to stress cracking. Such stress cracking can lead to premature failure and leaking of the containers and is therefore a significant problem for beverage and food manufacturers. In particular, certain types of surfactants, alcohols, glycols and alkaline materials are known to promote stress cracking.

While a number of PET-compatible surfactants have been commercialized in the past (e.g., Dicolube PL® sold by the Diversey Corporation), these are generally less than optimum owing to cost or stress cracking problems. There is accordingly a need in the art for improved, low-cost conveyor lubricant which can be used with PET or other thermoplastic containers without fear of inducing significant stress cracking problems.

SUMMARY OF THE INVENTION

The present invention provides lubricating compositions and methods especially designed for use with equipment used in the handling of thermoplastic articles subject to stress cracking. It is preferred that the compositions of the invention be initially formulated and sold as concentrates which can be diluted on-site to give the final use lubricants. Such products can then be conventionally sprayed or otherwise applied to the appropriate conveyors and/or handling equipment.

Broadly speaking, the concentrates of the invention are in the form of aqueous compositions which are essentially free of mineral or vegetable oil (i.e., no more than about 2% by weight oil) and including a nonionic surfactant dispersed in water. The surfactant should have a molecular weight of at least about 1000 and moreover have at least about 12 ethylene oxide moieties therein. The surfactant should also comprise about 50% by weight of the non-aqueous components of the lubricant. The diluted use lubricant derived from concentrates of the invention should have a crazing value as herein defined of at least about 2.5, and a lubricity ratio of up to about 0.830.

In more preferred embodiments, the nonionic surfactant component of the concentrates should comprise at least about 60% by weight of the non-aqueous components of the concentrates, and the crazing value should be at least about 2.8 with a lubricity ratio of up to about 0.750.

The most preferred surfactants for use in the concentrates of the invention are selected from the group consisting of: (a) ethylene oxide-propylene oxide copolymers of the general formula EO-PO-EO or PO-EO-PO (where EO refers to ethylene oxide moieties and PC refers to propylene oxide moieties); (b) phenol ethoxylates having the following formula

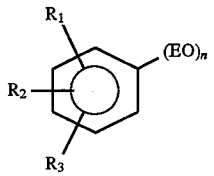

where $R_1$ is selected from the group consisting of straight or branched chain $C_8$–$C_{18}$ alkyl groups and substituted or unsubstituted $C_1$–$C_{18}$ alkylaryl groups, $R_2$ and $R_3$ are individually selected from the group consisting of hydrogen, straight or branched chain $C_8$–$C_{18}$ alkyl groups and substituted or unsubstituted $C_1$–$C_{18}$ alkylaryl groups, and n is from about 12–100; and (c)tetra-functional block copolymers derived from the sequential addition of propylene oxide and ethylene oxide to ethylene diamine.

Preferably, the surfactants should be selected from ethylene oxide-propylene oxide copolymers having a molecular weight of from about 1000–15000, and more preferably from about 6000–15000. In terms of ethylene oxide content, the copolymer should contain from about 10–90% by weight ethylene oxide, and more preferably from about 50–80% by weight ethylene oxide. The single most preferred class of copolymer surfactants are the ethylene oxide-propylene oxide copolymers.

Another class of useful surfactants are the dinonylphenol ethoxylates, and these should have a molecular weight of from about 1000–5000 with an ethylene oxide content of from about 60–95% by weight. Tristyrylphenol ethoxylates can also be used and would likewise have a molecular weight of from about 1000–5000 and an ethylene oxide content to from about 65–95% by weight.

The complete lubricant concentrates of the invention also typically include optional ingredients such as chelating agents, hydrotrope/solubilizers and preservatives. The chelating agents are particularly important where hard water is to be used a diluent with the concentrates. The chelating agents are used at a level of from about 1–10% by weight, and more preferably from about 3–7% by weight in the lubricant concentrates. Typical chelaters include ethylene diamine tetraacetic acid (EDTA), sodium salts of nitrilotriacetic acid, citric acid, polyacrylic acid, phosphates and complex phosphates such as sodium tripolyphosphate.

Hydrotrope/solubilizers are employed to enhance physical stability of the concentrates, particularly when exposed to temperature extremes. A wide variety of hydrotrope/solubilizers may be used including alcohols, glycols, ether solvents, anionic hydrotropes, low molecular weight (below about 800) surfactants and mixtures thereof. In preferred forms, it has been found that short chain acid soaps and partially neutralized alkyl or alkylaryl phosphate esters provide the best functionality without increasing stress cracking of thermoplastic containers.

The preservatives are normally used in very small quantities in order to improve the shelf life characteristics of the concentrate products. A wide variety of conventional preservatives can be used in this context. Additional optional ingredients may include foam boosters and/or dyes.

The following Table 1 sets forth the ingredients of the preferred concentrate products in accordance with the invention, and gives broad and preferred weight ranges for such components.

TABLE 1

| Concentrate Ingredients | Broad Range (Wt. %) | Preferred Range (Wt. %) |
|---|---|---|
| Nonionic Surfactant | 12–60 | 15–45 |
| Water | Balance | Balance |
| *Chelating Agent | 1–20 | 3–15 |
| *Hydrotrope/Solubilizer | 3–15 | 5–10 |
| *Preservative | 0.01–0.1 | 0.04–0.06 |
| *Foam Booster | 1–20 | 1–10 |
| *Dye | 0.005–0.1 | 0.01–0.05 |

*Indicates optional ingredients

As indicated, the concentrates of the invention are diluted on-site to create final use lubricants. The dilution normally gives a final use lubricant having therein from about 0.1–2.5% by weight lubricant concentrate, with the remainder being water. More preferably, the final use dilutions contain from about 0.2–2.0% by weight lubricant concentrate therein. The following Table 2 sets forth the ingredients as well as broad and preferred ranges of use for the use dilutions.

TABLE 2

| Use Dilution Ingredients | Broad Range | Preferred Range |
|---|---|---|
| Nonionic Surfactant (%) | 0.012–1.5 | 0.03–0.9 |
| Water | Balance | Balance |
| *Chelating Agent (%) | 0.001–0.5 | 0.006–0.3 |
| *Hydrotrope/Solubilizer (%) | 0.003–0.375 | 0.01–0.2 |
| *Preservative (%) | 0.00001–0.0025 | 0.00008–0.0012 |
| *Foam Booster (%) | 0.001–0.5 | 0.002–0.2 |
| *Dye (ppm) | 0.05–25 | 0.2–10 |

*Indicates optional ingredients

In actual practice, the use dilutions are simply sprayed or otherwise applied using conventional techniques onto the conveyor or handling equipment. Generally, the use dilutions may be sprayed continuously or intermittently as needed in order to establish the necessary lubricity for passage of the thermoplastic articles or containers. At the same time, the lubricants of the invention do not contribute significantly to stress cracking of the articles.

BRIEF DESCRIPTION OF THE DRAWING

The single FIGURE is a perspective view of the lubricant conveyor testing apparatus used in the determination of lubricity ratios.

DETAILED DESCRIPTION OF THE PREFERRED EMBODIMENTS

The following examples set forth preferred lubricant concentrates and use dilutions in accordance with the invention. It is to be understood that these examples are provided by way of illustration only and nothing therein should be taken as a limitation upon the overall scope of the invention.

EXAMPLES

A series of high molecular weight nonionic surfactants were prepared as aqueous lubricant concentrates and diluted to a level of 0.2% by weight surfactant for testing of lubricity. The tendency to stress crack PET bottles was tested with a 1% aqueous dilution. A commercial fatty acid soap-based Control Lubricant product that is not PET compatible was run as a negative control. Dicolube PL®, a commercially available PET approved lubricant, was used as a positive control. The results of these tests are set forth in Table 3.

TABLE 3

| Surfactant Type | Molecular Weight | Weight % EO | Concentration (Wt. %) | Crazing Value | Lubricity Ratio |
|---|---|---|---|---|---|
| EO-PO-EO[1] | 13000 | 80 | 20 | 2.8 | 0.607 |
| EO-PO-EO (prill) | 13000 | 80 | 15 | 3.1 | 0.628 |
| EO-PO-EO | 14000 | 80 | 10 | 2.9 | 0.628 |
| EO-PO-EO (prill) | 14000 | 80 | 10 | 3.0 | 0.629 |
| EO-PO-EO | 12500 | 70 | 10 | 2.8 | 0.710 |
| EO-PO-EO | 4600 | 50 | 25 | — | 0.965 |
| EO-PO-EO | 6500 | 50 | 25 | — | 0.799 |
| EO-PO-EO | 6500 | 50 | 10 | 2.5 | 0.847 |
| EO-PO-EO | 1900 | 50 | 25 | 2.3 | 1.078 |
| EO-PO-EO | 5000 | 20 | 10 | 2.6 | 1.053 |
| EO-PO-EO[2] | 1950 | 50 | 25 | 2.8 | 1.332 |
| EO-PO-EO (prill) | 8850 | 50 | 20 | 2.8 | 0.934 |
| NPE[3] | 748 | 70 | 25 | 2.4 | 0.881 |
| NPE | 4620 | 95 | 25 | 3.1 | 0.633 |

TABLE 3-continued

| Surfactant Type | Molecular Weight | Weight % EO | Concentration (Wt. %) | Crazing Value | Lubricity Ratio |
|---|---|---|---|---|---|
| DNPE[4] | 616 | 64 | 25 | 2.4 | — |
| DNPE | 994 | 66 | 25 | 2.7 | 0.768 |
| DNPE | 1402 | 75 | 25 | 2.7 | 0.776 |
| DNPE | 2376 | 91 | 25 | 2.8 | — |
| DNPE | >4620 | 95 | 25 | 3.2 | — |
| TSPE[5] | 1506 | 73 | 25 | 3.0 | — |
| TSPE | 1100 | 64 | 25 | 2.7 | 0.841 |
| TSPE | >4806 | 92 | 25 | 2.7 | — |
| TSPE | 1286 | 68 | 25 | 2.5 | — |
| Tetraonic 908 ®[6] | 25,000 | 80 | 20 | — | 0.703 |
| Tetronic 1107 ®[6] | 15,000 | 70 | 20 | — | 0.726 |
| Control Lubricant | N/A | N/A | N/A | 1.3 | 1.000 |
| Dicolube PL ® | N/A | N/A | N/A | 2.0 | 0.880 |
| Dicolube PL ® | N/A | N/A | N/A | 2.4 | 0.880 |

[1]EO-PE-EO is an ethylene oxide-propylene oxide block copolymer containing a central block of polypropylene oxide.
[2]PO-EO-PO is an ethylene oxide-propylene oxide copolymer containing a central block of ethylene oxide.
[3]NPE is a nonylphenyl ethoxylate having varying degrees of ethoxylation.
[4]DNPE is a dinonylphenyl ethoxylate having varying degrees of ethoxylation.
[5]TSPE is a tristyrylphenol ethoxylate having varying degrees of ethoxylation.
[6]The Tetronic surfactants are tetra-functional block copolymers derived from the sequential addition of propylene oxide and ethylene oxide to ethylene diamine. These surfactants provide slightly cationic properties and are commercialized by BASF.

The crazing value test results were obtained using the following analytical method. Apparatus and Reagents: balance, 2000 mL beaker, 1000 mL cylinder, 18×150 mm test tubes, Kitchen Aid® style mixer, 2 liter one-piece PET bottles with screw cap top, humidity oven, anhydrous citric acid, sodium bicarbonate and tap water.

Procedure:

1. The PET bottles were carbonated by filling each with 1850 mL of tap water and 30 g citric acid. Thirty grams of sodium bicarbonate powder were weighed out and placed into 18×150 mm test tubes, and a filled tube was floated in each filled 2 liter PET bottle. Each bottle (the bottles employed were standard and commercially available from Johnson Control, Inc. or Constar International™) was capped and slowly inverted (3–4 times) to dissolve the solids. Each bottle was then shaken to dissolve the powder, wearing a face shield. The filled bottles were then allowed to equilibrate overnight at room temperature.

2. A use solution of each test lubricant was prepared at a level of 2% by weight.

3. Three hundred mL of each use dilution was placed into the mixer and mixed for at least 3 minutes until a stiff lather was obtained.

4. Forty grams of each lather were placed in a two liter beaker.

5. The pre-carbonated 2 liter PET bottles were then placed into respective lather-filled beakers and allowed to sit for 4–5 hours in order to allow the foam to evaporate. At least 4 PET bottles were tested for each test lubricant.

6. The beakers with the bottles therein were then placed into a humidity oven (38°–40° C. 85% relative humidity) for 14 days with periodic checking to insure that at least 30 mL of the liquid use dilution remained at the bottom of each beaker at all times.

7. Each bottle was checked each day for leaks, and a record was made of the number of leakers per day and the number of days into the test when the leaking occurred. After 14 days, the average crazing value was recorded for each lubricant tested, following the guidelines below and with special attention being paid to crazing at the bottom of the bottles.

8. Crazing Value: 4=no sign of crazing, to infrequent, small, shallow crazes; 3=small, frequent, shallow to infrequent, medium depth crazes which can be felt with a fingernail; 2=frequent medium depth to infrequent deep crazes; 1=leakers (cracked). Therefore, a higher crazing value indicates better performance.

The lubricity ratio data was obtained using the following analytical method.

Apparatus and Reagents: Lubricant Conveyor Testing Apparatus, Model AD-4321 weighing indicator, lubricant testing program (the program in Basic Language is set forth in an appendix), a Control Lubricant: PET sled with weights, tap water and soft water.

Referring to the FIGURE, the Lubricant Conveyor Testing Apparatus 10 includes an upstanding frame 12 carrying an metallic conveyor assembly 14 and conveyor motor 16. The conveyor assembly 14 includes a pair of sidewalls 17, 18 and front and rear end walls 20, 22. An endless Delrin conveyor 24 is disposed between sidewalls 17, 18 as shown. The apparatus 10 further includes a conventional load cell 26 (Model RL20000A-100, Rice Lake Weighing Systems) coupled via cable 28 to Model AD-4321 weighing indicator 29, the latter being connected to IBM PC computer 30. Three spaced apart lubricant spray heads 31 are positioned adjacent wall 22 below load cell 26, and are connected via conduit 32 to a controller 34. A secondary conduit 36 extends from controller 34 to a supply of lubricant (not shown) or alternately to a source of tap water. The controller 34 is operable to control the amount and timing of conveyor lubricant directed to the heads 31 for application to conveyor 24. The controller 34 includes a fluid pump (Knight Model PMP-560 having a capacity of about 5 gal/hr.).

The overall apparatus 20 further includes a wooden test sled 38 sized to fit on the Delrin conveyor 24 between sidewalls 17, 18. A sheet 40 of PET material is secured to the underside of pallet 38 and directly engages the moving conveyor 24 during testing. A pair of plastic boxes 42, 44 rest atop pallet 38 as shown and are adapted to hold a constant weight in the form of containers of water. The weight chosen is approximately 90 pounds. A chain 46 extends around the weight boxes 42, 44 and is operatively connected to load cell 26. The weighing indicator 29 is operatively coupled to the load cell 26 and gives a reading in terms of pounds of load. Data is read by the computer 30 and is conventionally displayed.

Procedure:

1. The conveyor is turned on and the system is flushed with tap water until the weighing indicator reaches a substantially constant baseline (readings between 19.0–24.0 pounds).

2. Ten gallons of the Control Lubricant are prepared at the use dilution. The Control Lubricant was initially prepared as a concentrate consisting of the following ingredients on a percent by weight basis: caustic potash (45%), 3.95%, Dowicil® 75 (a water soluble preservative having 1-(3-chloroallyl)-3,5,7-triaza-1-azoniaadamantane chloride as the active ingredient, 0.05%, hexylene glycol, 5.00%, Igepal CO-720® (a polyethoxylated surfactant sold by GAF), 2%, isopropanol (99%), 2.00%, Latol® (a high purity grade tall oil fatty acid), 13.50%, Ninol 11CM® (a modified coconut diethanolamide surfactant sold by Stepan, Inc.), 13.50%, Pluronic L-62® (Poloxamer 182, a polyoxyethylene-polyoxypropylene block polymer sold by BASF), 4.00%, propylene glycol USP, 4.00%, Versene® (a tetrasodium ethylenediaminetetraacetic acid sold by Dow Chemical Company), 15.00%, soft water, 13.00%. This concentrate was diluted to achieve a final use Control Lubricant made up of 0.2% by weight of the concentrate in water.

3. With the conveyor at its baseline, the lubricant testing program is initiated. After the initial reading, the conveyor pump is switched from tap water to the Control Lubricant. The Control Lubricant should be run for at least 2 hours in order to reach its equilibrium point at which a substantially constant reading is obtained.

4. Once the equilibrium point is reached, the lubricant testing program is ended and the pump is switched from the Control Lubricant to tap water to flush the system until the weighing indicator returns to the baseline.

5. Prepare 10 gallons of the test lubricant at 0.2% by weight lubricant composition in water.

6. With the conveyor at its baseline, the lubricant testing program is initiated. After the initial reading, the conveyor pump is switched from tap water to the test lubricant. The test lubricant is run for at least 2 hours in order to reach its equilibrium point.

7. The lubricity ratio is determined as the ratio of the test lubricant reading at equilibrium divided by the Control Lubricant reading at equilibrium. Therefore, a lower lubricity ratio represents better performance.

As used herein, the "crazing value" for a particular lubricant is determined as set forth above; likewise, as used herein the "lubricity ratio" is determined by the foregoing procedure.

As can be seen from the results of Table 3, the high molecular weight nonionic surfactant lubricants tend to give improved lubricity ratio and crazing value results, as compared with both PET-approved and non-PET-approved commercial lubricants. These results also indicate that within each type of surfactant the lubricity ratio tends to increase with molecular weight and ethylene oxide content, while the crazing value tends to decrease.

In another series of tests, three fully formulated conveyor lubricant concentrates were prepared containing chelating agents, preservatives and hydrotrope/solubilizers in addition to the surfactant lubricating ingredient. The concentrate compositions were prepared using the following ingredients, diluted to a level of 0.2% by weight in water, and tested for lubricity ratio. Crazing values were determined at 2% concentration.

TABLE 4

| Ingredients (% By Wt.) | Lubricant A | Lubricant B | Lubricant C |
|---|---|---|---|
| Pluronic F-108 ®[1] | 20.0 | 20.0 | 20.0 |
| EDTA (39%) | 5 | 5 | 5 |
| Dowicil 75 ®[2] | 0.05 | 0.05 | 0.05 |
| Monotrope 1250 ®[3] | 10 | — | — |
| Rhodafac RA-600 ®[4] | — | 5 | — |
| Monotax 1214 ®[5] | — | — | 5 |
| Water | 64.95 | 69.95 | 69.95 |
| | Test Results | | |
| Crazing Value | 2.9 | 2.7 | 2.9 |
| Lubricity Ratio | 0.638 | 0.656 | 0.616 |

[1]Pluronic F-108 ® is an ethylene oxide-propylene oxide block copolymer containing a central block of polypropylene oxide; it has a molecular weight of 600 and a pour point of 57° C., and is sold by BASF, Inc. Further details about this material can be obtained from a product brochure entitled "Pluronic and Tetronic Surfactants" published by the manufacturer, which is incorporated by reference herein.

[2]Dowicil 75 ® is a preservative commercialized by the Dow Chemical Company having the active ingredient 1-(3-chloroallyl)-3,5,7-triaza-1-azoniaadamantane chloride.

[3]Monotrope 1250 ® is a sodium isononanoate commercialized by Mona Industries, Inc.; further details about this composition can be obtained from a brochure entitled "Monotrope 1250" published by the manufacturer and which is incorporated by reference herein.

[4]Rhodafac RA-600 ® is a phosphate ester hydrotrope commercialized by Rhone-Poulenc; further details about this composition can be obtained from a brochure entitled "Rhodafac" published by the manufacturer and which is incorporated by reference herein.

[5]Monofax 1214 ® is an anionic deceth-4 phosphate material used as a detergent, foamer, dispersant and wetting agent; further details about this composition can be obtained from a brochure entitled "Monotax 1214" published by the manufacturer and which is incorporated by reference herein.

The tests results of Table 4 demonstrate that the lubricants of the invention show a marked superiority over the commercially available PET-approved lubricant Dicolube PL®, which had a crazing value of 2.0–2.4 and a lubricity ratio of 0.880 (see Table 3).

```
100  REM SOFTWARE FOR MODEL AD-4321/A WEIGHING INDICATOR
110  REM WEST AGRO INC.
120  REM CHRIS FORET OCTOBER 1992
130  REM AA=AVERAGE WEIGHT READING
140  REM A1(I)=INDIVIDUAL WEIGHT READING
150  REM AM=MAXIMUM WEIGHT READING
160  REM AL=LOWEST WEIGHT READING
170  REM AT=AVERAGE WEIGHT READING
180  REM N1$=NA$=CONCENTRATION OF LUBE
190  REM N2$=NB$=NAME OF LUBE
200  REM N3$=NC$=LOAD WEIGHT
210  REM N4$=ND$=CONVAYER SPEED
220  REM N5$=NE$=SOIL TYPE AND CONCENTRATION
230  REM T=CURRENT TIME
```

-continued

```
240  REM T0=STARTING TIME
250  REM TC=CURRENT TIME RELATIVE TO STARTING TIME IN HOURS
260  REM X$=MENU CHOICE
270  CLEAR
280  DIM A1(100)
290  OPEN "I", #1, "/lubedata/NAMES"
300  INPUT #1, NA$,NB$,NC$,ND$,NE$,NF$
310  CLOSE #1
320  PRINT "MODEL AD-4321/A WEIGHING INDICATOR"
330  PRINT "LUBRICANT TESTING APPARATUS"
340  PRINT
350  PRINT
360  PRINT " 1 - ENTER INFORMATION AND COLLECT DATA FOR A LUBRICANT"
370  PRINT " 2 - PRINT OUT RESULTS TO THE SCREEN"
380  PRINT " 3 - PRINT OUT RESULTS TO A PRINTER"
390  PRINT " 4 - PRINT OUT A LIST OF DATA FILES"
400  PRINT " 5 - EXIT PROGRAM"
410  PRINT
420  PRINT "TYPE IN THE YOUR SELECTION (1–5) = ?";
430  INPUT X$
440  X=VAL(X$)
450  X=ABS(X)
460  IF X<1 OR X>5 THEN 320
470  ON X GOTO 480,600,610,620,1440
480  GOSUB 630
490  T0=TIMER
500  GOTO 550
510  T1=TIMER
520  IF (T1–T)/3600>.1 THEN 550
530  ON KEY 81 GOSUB 1390
540  GOTO 510
550  GOSUB 1070
560  TC=(T–T0) /3600
570  GOSUB 1320
580  PRINT "HOURS=";TC;" AVERAGE=";AA;"   MAX=";AM;"   LOW=";AL;"   PRESS Q TO QUIT"
590  GOTO 510
600  GOTO 1440
610  GOTO 1440
620  GOTO 1440
630  REM SUBROUTINE TO RECORD INFORMATION ABOUT RUN
640  REM XXXXXXXXXXXXXXXXXXXXXXXXXXXXXXXXXXXXXXXXXXXXXXXX
650  REM XXXXXXXXXXXXXXXXXXXXXXXXXXXXXXXXXXXXXXXXXXXXXXXX
660  PRINT "CONCENTRATION OF LUBE BEING TESTED (";NA$;")? ";
670  INPUT N1$
680  IF N1$<>""THEN 700
690  N1$=NA$
700  NA$=N1$
710  PRINT "TYPE IN THE NAME OF THE PRODUCT BEING TESTED (";NB$;")? ";
720  INPUT N2$
730  IF N2$<>""THEN 750
740  N2$=NB$
750  NB$=N2$
760  PRINT "LOAD WEIGHT (";NC$;")? ";
770  INPUT N3$
780  IF N3$<>""THEN 800
790  N3$=NC$
800  NC$=N3$
810  PRINT "CONVAYER SPEED (";ND$;")? ";
820  INPUT N4$
830  IF N4$<>""THEN 850
840  N4$=ND$
850  ND$=N4$
860  PRINT "SOIL TYPE AND CONCENTRATION (";NE$;")? ";
870  INPUT N5$
880  IF N5$<:>""THEN 900
890  N5$=NE$
900  NE$=N5$
910  PRINT "TODAYS DATE (";NF$;")? ";
920  INPUT N6$
930  IF N6$<>""THEN 950
940  N6$=NF$
950  NF$=N6$
960  OPEN "O",#1,"/LUBEDATA/NAMES"
970  PRINT #1, NA$;",";NB$;",";NC$;",";ND$;",";NE$;",";NF$
980  CLOSE 1
990  PRINT "TYPE IN A FILE NAME FOR THE DATA"
1000 PRINT "USE EIGHT LETTERS OR NUMBERS FOR THE FILE NAME"
1010 PRINT "FILE NAME = ?";
1020 INPUT F$
1030 IF LEN(F$)<>8 THEN 990
```

-continued

```
1040 PRINT "PRESS RETURN TO START COLLECTING DATA"
1050 INPUT X$
1060 RETURN
1070 REM SUBROUTINE TO COLLECT DATA
1080 REM XXXXXXXXXXXXXXXXXXXXXXXXXXXXXXXXXXXXXXXXXXXXXXXX
1090 REM XXXXXXXXXXXXXXXXXXXXXXXXXXXXXXXXXXXXXXXXXXXXXXXX
1100 T=TIMER
1110 PRINT T
1120 AM=0
1130 AT=0
1140 AL=10000
1150 OPEN "COM2:2400,E,7,1" AS #1
1160 PRINT #1, "CLEAR"+CHR$(13)+CHR$(10);
1170 FOR I=1 TO 400
1180 NEXT I
1190 FOR K=1 TO 100
1200 PRINT #1, "READ"+CHR$(13)+CHR$(10);
1210 INPUT #1, A$, B$, C$, D$
1220 A1 (K)=VAL(C$
1230 NEXT K
1240 FOR K = 1 TO 100
1250 AT = AT+A1 (K)
1260 IF AM<A1 (K) THEN AM=A1 (K)
1270 IF AL>A1 (K) THEN AL=A1 (K)
1280 NEXT K
1290 AA=AT/100
1300 PRINT "Average = ";AA, AM, AL
1310 CLOSE #1
1320 REM SUBROUTINE TO STORE DATA IN A FILE
1330 REM XXXXXXXXXXXXXXXXXXXXXXXXXXXXXXXXXXXXXXXXXXXXXXXX
1340 REM XXXXXXXXXXXXXXXXXXXXXXXXXXXXXXXXXXXXXXXXXXXXXXXX
1350 OPEN "/LUBEDATA/";F$ FOR APPEND AS #1
1360 PRINT #1,TC;AA;AM;AL
1370 CLOSE 1
1380 RETURN
1390 REM RESTART ROUTINE
1400 REM XXXXXXXXXXXXXXXXXXXXXXXXXXXXXXXXXXXXXXXXXXXXXXXXX
1410 REM XXXXXXXXXXXXXXXXXXXXXXXXXXXXXXXXXXXXXXXXXXXXXXXXX
1420 GOTO 320
1430 RETURN
1440 END
```

We claim:

1. A method of lubricating handling equipment for thermoplastic articles subject to stress cracking comprising the step of applying to said equipment an aqueous use lubricant essentially free of oil and including a nonaqueous fraction dispersed in water, said nonaqueous fraction comprising a nonionic surfactant fraction constituting at least about 50% by weight of said nonaqueous fraction and consisting essentially of a substituted phenol ethoxylate surfactant having a molecular weight of at least about 1000 and having at least about 12 ethylene moieties therein, said substituted phenol ethoxylate having the formula

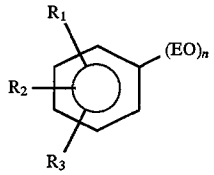

wherein $R_1$ is selected from the group consisting of straight or branched chain $C_8$–$C_{18}$ alkyl groups and substituted or unsubstituted $C_1$–$C_{18}$ alkylaryl groups, $R_2$ and $R_3$ are individually selected from the group consisting of hydrogen, straight or branched chain $C_8$–$C_{18}$ alkyl groups and substituted or unsubstituted $C_1$–$C_{18}$ alkylaryl groups, and n is from about 12–100.

2. The method of claim 1, said lubricant having a crazing value of at least about 2.5 and a lubricity ratio of up to about 0.830.

3. The method of claim 2, said crazing value being at least about 2.8, and said lubricity ratio being up to about 0.750.

4. The method of claim 1, said surfactant comprising at least about 60% by weight of the non-aqueous components of said lubricant.

5. The method of claim 1, said lubricant including from about 0.012–1.5% by weight of said surfactant therein.

6. The method of claim 5, said level being from about 0.03–0.9% by weight.

7. The method of claim 1, said lubricant including a hydrotrope/solubilizer therein.

8. The method of claim 7, said hydrotrope/solubilizer being present at a level of from about 0.003–0.375% by weight.

9. The method of claim 8, said level being from about 0.01–0.2% by weight.

10. The method of claim 1, said lubricant including a chelating agent.

11. The method of claim 10, said chelating agent being present at a level of from about 0.001–0.5% by weight.

12. The method of claim 11, said level being from about 0.006–0.3% by weight.

13. The method of claim 1, said lubricant including a preservative therein.

14. A lubricant concentrate adapted for dilution in water to form a diluted use lubricant which can be applied to handling equipment for thermoplastic articles subject to stress cracking, said lubricant concentrate comprising an aqueous composition essentially free of oil and including a nonaqueous fraction dispersed in water, said nonaqueous fraction comprising a nonionic surfactant fraction constituting at least about 50% by weight of said nonaqueous fraction and consisting essentially of a substituted phenol ethoxylate surfactant having a molecular weight of at least about 1000 and having at least about 12 ethylene moieties therein, said substituted phenol ethoxylate having the formula

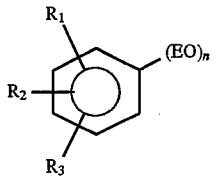

wherein $R_1$ is selected from the group consisting of straight or branched chain $C_8$–$C_{18}$ alkyl groups and substituted or unsubstituted $C_1$–$C_{18}$ alkylaryl groups, $R_2$ and $R_3$ are individually selected from the group consisting of hydrogen, straight or branched chain $C_8$–$C_{18}$ alkyl groups and substituted or unsubstituted $C_1$–$C_{18}$ alkylaryl groups, and n is from about 12–100.

15. The lubricant concentrate of claim 14, wherein the diluted use lubricant derived from said concentrate has a crazing value of at least about 2.5 and a lubricity ratio of up to about 0.830.

16. The lubricant concentrate of claim 15, said crazing value being at least about 2.8, and said lubricity ratio being up to about 0.750.

17. The lubricant concentrate of claim 14, said surfactant comprising at least about 60% by weight of the non-aqueous components of said lubricant concentrate.

18. The lubricant concentrate of claim 14, wherein said lubricant includes from about 12–60% by weight of said surfactant therein.

19. The lubricant concentrate of claim 18, said level being from about 15–45% by weight.

20. The lubricant concentrate of claim 14, said lubricant including a hydrotrope/solubilizer therein.

21. The lubricant concentrate of claim 20, said hydrotrope/solubilizer being present at a level of from about 3–15% by weight.

22. The lubricant concentrate of claim 21, said level being from about 5–10% by weight.

23. The lubricant concentrate of claim 14, said lubricant including a chelating agent.

24. The lubricant concentrate of claim 23, said chelating agent being present at a level of from about 1–20% by weight.

25. The lubricant concentrate of claim 24, said level being from about 3–15% by weight.

26. The lubricant concentrate of claim 14, said lubricant including a preservative therein.

27. A dilute aqueous use lubricant adapted for application to equipment for handling of thermoplastic articles subject to stress cracking, said use lubricant comprising an aqueous composition essentially free of oil and comprising a non-aqueous fraction dispersed in water, said nonaqueous fraction including a nonionic surfactant fraction constituting at least about 50% by weight of said nonaqueous fraction and consisting essentially of a substituted phenol ethoxylate surfactant having a molecular weight of at least about 1000 and having at least about 12 ethylene moieties therein, said substituted phenol ethoxylate having the formula

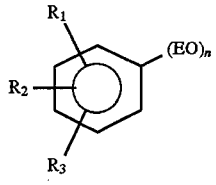

wherein $R_1$ is selected from the group consisting of straight or branched chain $C_8$–$C_{18}$ alkyl groups and substituted or unsubstituted $C_1$–$C_{18}$ alkylaryl groups, $R_2$ and $R_3$ are individually selected from the group consisting of hydrogen, straight or branched chain $C_8$–$C_{18}$ alkyl groups and substituted or unsubstituted $C_{1-C18}$ alkylaryl groups, and n is from about 12–100.

28. The use lubricant of claim 27, wherein the diluted lubricant derived from said concentrate has a crazing value of at least about 2.5 and a lubricity ratio of up to about 0.830.

29. The use lubricant of claim 28, said crazing value being at least about 2.8, and said lubricity ratio being up to about 0.750.

30. The use lubricant of claim 27, said surfactant comprising at least about 60% by weight of the non-aqueous components of said use lubricant.

31. The use lubricant of claim 27, wherein said lubricant includes from about 0.012–1.5% by weight of said surfactant therein.

32. The use lubricant of claim 31, said level being from about 0.03–0.9% by weight.

33. The use lubricant of claim 27, said lubricant including a hydrotrope/solubilizer therein.

34. The use lubricant of claim 33, said hydrotrope/solubilizer being present at a level of from about 0.003–0.375% by weight.

35. The use lubricant of claim 34, said level being from about 0.01–0.2% by weight.

36. The use lubricant of claim 27, said lubricant including a chelating agent.

37. The use lubricant of claim 36, said chelating agent being present at a level of from about 0.001–0.5% by weight.

38. The use lubricant of claim 37, said level being from about 0.006–0.3% by weight.

39. The use lubricant of claim 27, said lubricant including a preservative therein.

* * * * *